US009129512B2

(12) United States Patent
Vigouroux

(10) Patent No.: US 9,129,512 B2
(45) Date of Patent: Sep. 8, 2015

(54) REMOTE CONTROL DEVICE OF AN ELECTRIC EQUIPMENT

(75) Inventor: Didier Vigouroux, Brignoud (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 604 days.

(21) Appl. No.: 13/431,211

(22) Filed: Mar. 27, 2012

(65) Prior Publication Data

US 2012/0256734 A1 Oct. 11, 2012

(30) Foreign Application Priority Data

Apr. 8, 2011 (FR) ..... 11 01077

(51) Int. Cl.
*G08C 19/16* (2006.01)
*G08C 17/00* (2006.01)

(52) U.S. Cl.
CPC ..... *G08C 17/00* (2013.01); *G08C 2201/112* (2013.01)

(58) Field of Classification Search
USPC ..... 340/12.29, 12.5, 568.1; 439/131, 133, 439/136; 361/730, 737; 235/380
See application file for complete search history.

(56) References Cited

U.S. PATENT DOCUMENTS 5,561,331 A * 10/1996 Suyama et al. ..... 307/10.3
5,844,516 A 12/1998 Viljanen
5,963,872 A * 10/1999 Stein ..... 455/557
6,043,753 A 3/2000 Okayasu et al.
6,077,107 A 6/2000 Hetherington
6,386,007 B1 * 5/2002 Johnson et al. ..... 70/408
6,439,956 B1 * 8/2002 Ho ..... 446/454
6,460,386 B1 * 10/2002 Watanuki et al. ..... 70/456 R
6,636,272 B1 * 10/2003 Noguchi et al. ..... 348/734
6,765,311 B1 * 7/2004 Labonde ..... 307/10.1
6,991,479 B2 * 1/2006 Miao ..... 439/133
7,098,791 B2 * 8/2006 Okada ..... 340/568.1
7,310,980 B2 * 12/2007 Hashimoto et al. ..... 70/456 R
7,400,917 B2 7/2008 Wood et al.
7,401,634 B2 7/2008 Kovach et al.
7,513,134 B2 * 4/2009 Hashimoto et al. ..... 70/456 R
7,530,823 B1 * 5/2009 Thornton et al. ..... 439/136
7,535,719 B2 * 5/2009 Hiew et al. ..... 361/737
7,597,250 B2 * 10/2009 Finn ..... 235/380
7,632,113 B2 * 12/2009 Finn ..... 439/131
7,674,120 B2 * 3/2010 Morganstern et al. ..... 439/131
7,841,873 B2 * 11/2010 Zhu et al. ..... 439/131
8,155,748 B1 4/2012 Walsh et al.
8,184,441 B2 * 5/2012 Meng et al. ..... 361/730

(Continued)

FOREIGN PATENT DOCUMENTS

EP 2 159 772 A1 3/2010
JP 10020874 A * 1/1998 ..... G10K 15/04

(Continued)

*Primary Examiner* — Paul Obiniyi
(74) *Attorney, Agent, or Firm* — Steptoe & Johnson LLP

(57) ABSTRACT

A remote control having a button for actuating an electric equipment unit, a dongle controlled by the remote control for transmitting control orders to the equipment unit, and a housing having a designated location for the dongle, the housing having a two-part case which is convertible from open to closed positions but not closable if the dongle is not in its designated location, the two parts of the case being slidable between two positions, with a latch between the two positions, and which is movable by removal or insertion of the dongle.

13 Claims, 6 Drawing Sheets

(56) References Cited

U.S. PATENT DOCUMENTS

Figure 1:
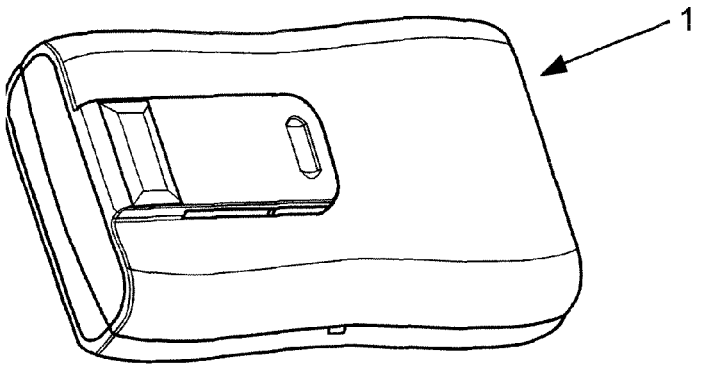

| | | | | |
|---|---|---|---|---|
| 8,194,408 | B2 * | 6/2012 | Chou et al. | 361/737 |
| 8,217,893 | B2 * | 7/2012 | Quinn et al. | 345/157 |
| 8,388,361 | B2 * | 3/2013 | Wavra et al. | 439/131 |
| 8,479,547 | B2 * | 7/2013 | Kataya et al. | 70/456 R |
| 2001/0017616 | A1 * | 8/2001 | Kobayashi | 345/173 |
| 2002/0190610 | A1 | 12/2002 | Andre et al. | |
| 2004/0071471 | A1 | 4/2004 | Baker et al. | |
| 2004/0198470 | A1 | 10/2004 | Dyer et al. | |
| 2005/0012594 | A1 * | 1/2005 | Shim | 340/5.72 |
| 2005/0202698 | A1 * | 9/2005 | Miao | 439/133 |
| 2005/0223766 | A1 * | 10/2005 | Hashimoto et al. | 70/456 R |
| 2006/0131431 | A1 * | 6/2006 | Finn | 235/492 |
| 2006/0219776 | A1 * | 10/2006 | Finn | 235/380 |
| 2007/0064360 | A1 | 3/2007 | DeBoer et al. | |
| 2007/0100935 | A1 * | 5/2007 | Miyazaki et al. | 709/203 |
| 2007/0173197 | A1 | 7/2007 | Hsiung | |
| 2008/0105015 | A1 * | 5/2008 | Hashimoto et al. | 70/456 R |
| 2008/0125065 | A1 | 5/2008 | Das et al. | |
| 2008/0224542 | A1 | 9/2008 | Freeman et al. | |
| 2008/0229794 | A1 | 9/2008 | Fujimoto | |
| 2008/0280490 | A1 * | 11/2008 | Nguyen et al. | 439/607 |
| 2009/0033621 | A1 * | 2/2009 | Quinn et al. | 345/158 |
| 2010/0283624 | A1 * | 11/2010 | Krueger | 340/825 |
| 2010/0308664 | A1 | 12/2010 | Face et al. | |
| 2010/0323644 | A1 | 12/2010 | Bataille et al. | |
| 2011/0109201 | A1 | 5/2011 | Ozawa et al. | |
| 2011/0302970 | A1 * | 12/2011 | Amron | 70/456 R |
| 2013/0186154 | A1 * | 7/2013 | Haas | 70/336 |

FOREIGN PATENT DOCUMENTS

| | | | |
|---|---|---|---|
| WO | WO 2005/069245 | A1 | 7/2005 |
| WO | WO 2007/120892 | A2 | 10/2007 |
| WO | WO 2009/052121 | A2 | 4/2009 |

* cited by examiner

REMOTE CONTROL DEVICE OF AN ELECTRIC EQUIPMENT

The object of the present invention is to provide a device for remote control of an electric equipment unit comprising a remote control comprising at least one actuating button of the mechanism of the equipment unit by means of remote transmission means provided partly in the remote control and partly in an interface of the equipment unit, and also to provide a control method for implementation of this device.

Direct operation of a medium-voltage cubicle may sometimes give rise to certain fears justified by the loud noise caused by the operation, fear of human error being able to lead to earthing of a part of a live power system thus resulting in short-circuiting that may cause additional noise, or the occurrence of an internal arc on faulty electric equipment. It is therefore sometimes necessary to allay the fear of operating the medium-voltage cubicle directly for example by providing the possibility of moving a few meters away from the equipment unit to be commanded or of leaving the premises with possibly the presence of a wall between the operator and the unit to be commanded. Thus for example, in the case of an overhead equipment unit associated with a controller located on a post, the operator can work at the foot of the post rather than up a ladder.

Hard-wired solutions also exist (hard-wired remote control) which on account of their principle are dedicated to a single equipment unit (or group of equipment units), but the latter are generally installed on equipment that is scheduled to be operated regularly.

Remote control devices for circuit breakers are known such as described in the documents WO200952121 or US2007064360 and a device for secured pairing between the remote control and the controlled object is also known as described in Patent WO2007120892.

The object of the present invention is to provide a method for remote control of an electric equipment unit that is of simple design and is inexpensive to produce, enabling remote control of different types of equipment, this remote control being advantageously able to be implemented without any wiring and without batteries, enabling dependable pairing between the remote control and the controlled equipment unit.

For this purpose, the object of the present invention is to provide a control device of the above-mentioned kind, this device being characterized in that it comprises a dongle designed to be inserted into the control interface of the equipment unit to be connected to the mechanism of the equipment unit by a connector, said dongle being controlled by the remote control and being designed to transmit the control orders from the remote control to the mechanism of the equipment unit, said dongle being stowed in a location provided for this purpose inside the casing of the remote control after use.

According to a particular feature, this device comprises a pairing device between the remote control and the dongle enabling the remote control to identify the equipment unit to be commanded.

According to another feature, the above-mentioned transmission means comprise wireless transmission means.

According to a particular feature, the transmission means use the ZigBee short-range radio system and the above-mentioned pairing means use the MAC address of the ZigBee radio.

According to another feature, the housing of the remote control comprises a case able to take two positions, respectively an open position and a closed position, said case enabling access to the actuating button(s) of the remote control in the open position and preventing access to this button or these buttons in the closed position.

According to another feature, the housing of the remote control comprises a case able to take two positions, respectively an open position and a closed position, and this case comprises means for preventing closing of the case so long as the dongle has not been put back in its location inside the housing of the remote control.

According to another feature, this case comprises two parts fitted sliding with respect to one another, and these means comprise a latch fitted sliding inside one called first of the above-mentioned parts between two positions and able to be moved by the dongle when the latter is inserted in the housing of the remote control or is removed from the latter, in such a way that when the dongle is removed from the housing, this latch is in the active position and cooperates with the second part of the case so as to prevent relative sliding of these two parts and when the dongle is inside the remote control, the latch is in the inactive position and enables this movement.

According to another feature, this latch comprises a part in the form of a bridge mounted sliding inside this first part of the case and a latching member, the assembly being designed to receive the dongle with sliding, said dongle being able to slide between this first part of the case and said bridge when it is inserted or removed and cooperating with said bridge so as to drive said bridge between a first position in which the latching member is inside the housing of this first part and a second position in which this latching member is salient from the housing of this first part so as to interfere with the housing of the second part of the case thereby preventing relative sliding of these two parts, said latch being biased to the inactive position by a spring.

According to another feature, the dongle cooperates with a ramp formed on the bridge.

According to another feature, the housing of the remote control comprises indicating means designed to inform the user of receipt of a control order by the equipment unit.

According to another feature, the equipment unit is a medium-voltage switch or circuit breaker, a controller or a protection relay designed to control a circuit breaker or a switch.

According to another feature, the remote control is commanded by an energy generating system operating without batteries, the energy being provided by pressing or releasing the above-mentioned button(s).

It is a further object of the present invention to provide a method for implementation of a device comprising the above-mentioned features taken alone or in combination, said device comprising a first sequence called first actuating sequence of a generator and a second sequence called second actuating sequence of said generator, characterized in that during the first sequence, actuation of the generator enables the energy of the first actuation to be stored and stores the information of a control order to be sent to the equipment unit, second actuation of the generator enabling the energy of this second actuation to be stored, the control order to be sent to the electric equipment unit by means of the information of a control order to be sent stored in sequence 1, and the information of effective transmission of the control order to be sent to indicating means.

According to a particular feature, the above-mentioned energy generator comprises a push-button and this generator is actuated a first time when this button is depressed and is actuated a second time when this button is released.

According to another feature, the above-mentioned energy is stored in a capacitor.

Figure 2:
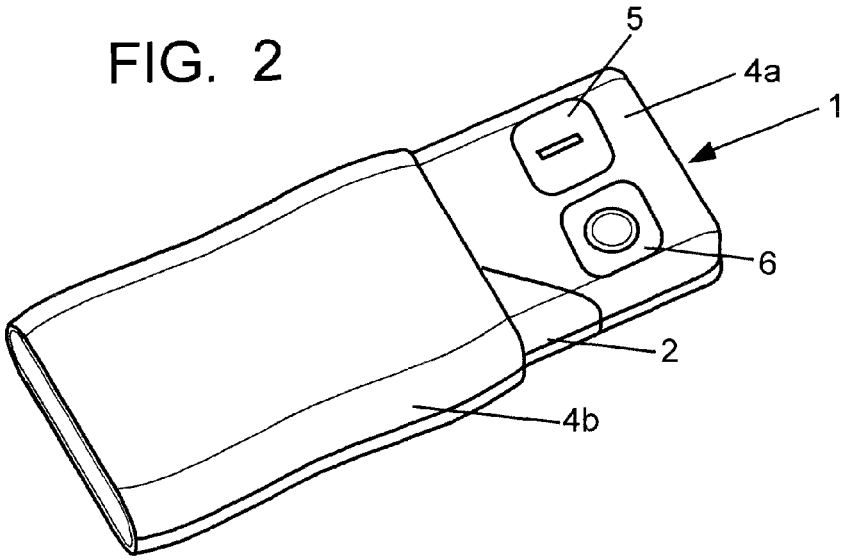
Figure 3:
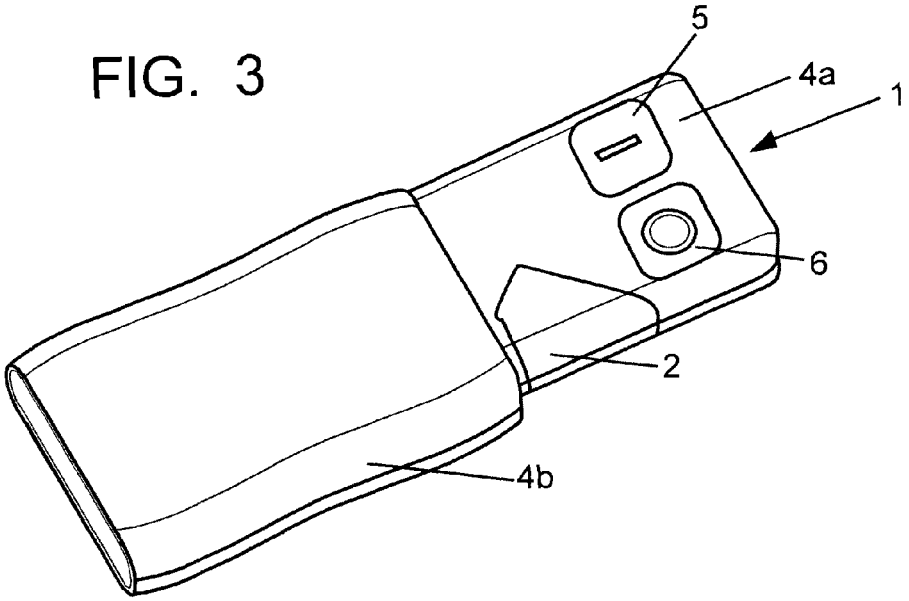
Figure 4:
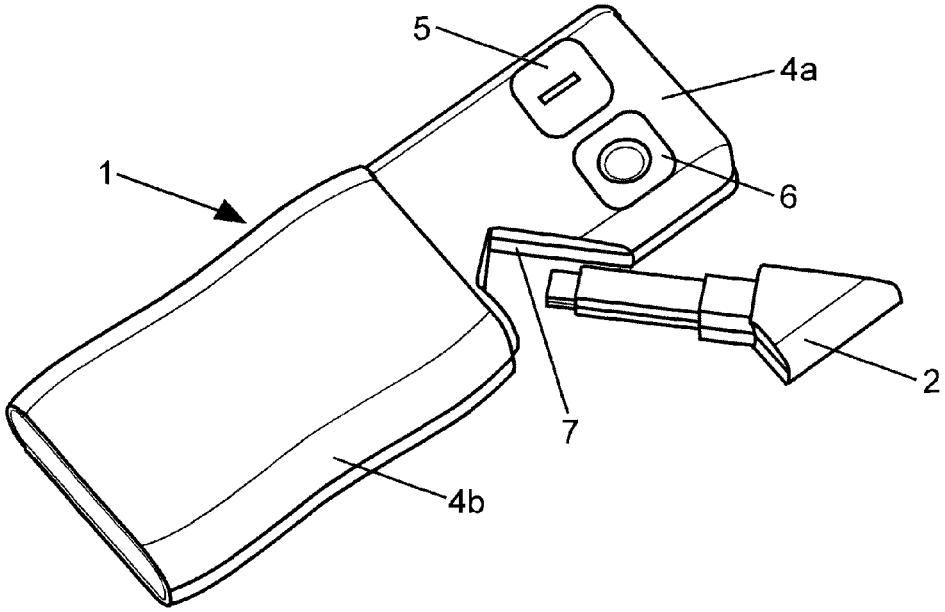
Figure 5:
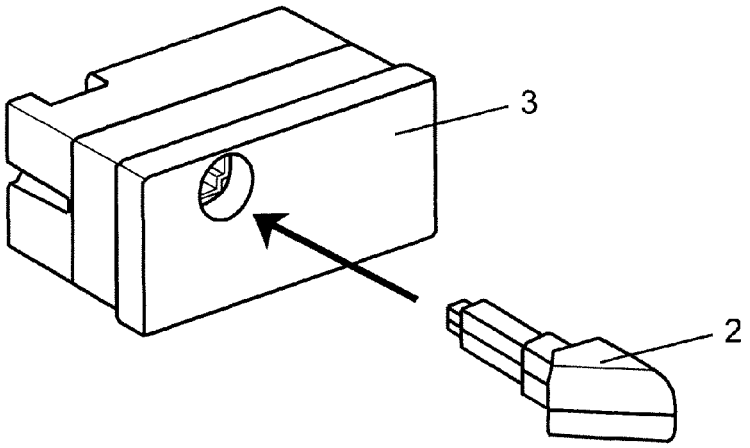
Figure 6:
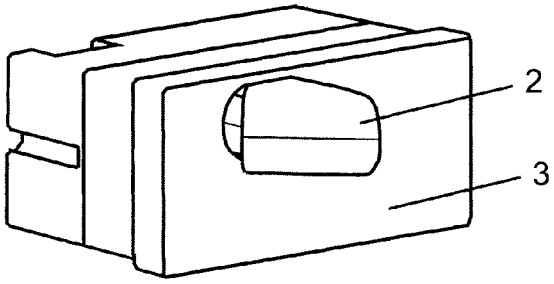
Figure 7:
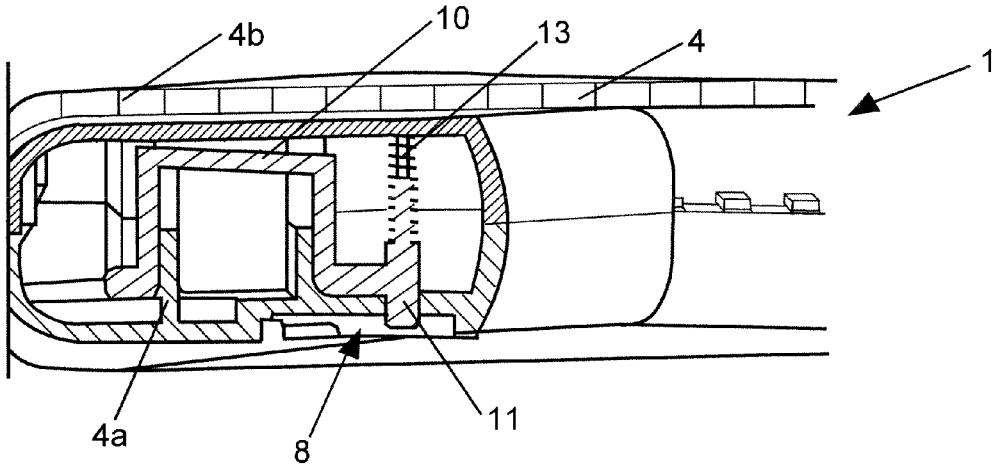
Figure 8:
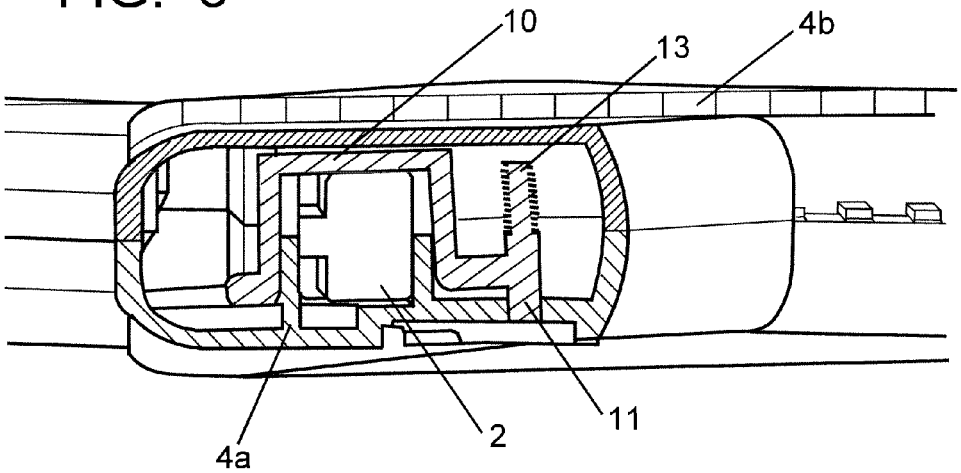

But other advantages and features of the invention will become more clearly apparent from the following detailed description which refers to the appended drawings given for example purposes only and in which:

FIG. 1 is a perspective view of a remote control belonging to a control device according to the invention, in the closed position, FIG. 2 is a perspective view of the same remote control in the semi-open position, FIG. 3 is a perspective view of the same remote control in the open position, the dongle still being inside the remote control, FIG. 4 is an identical view to the previous view, the dongle having been removed from the case, FIG. 5 is a perspective view of the circuit breaker control unit before insertion of a dongle, FIG. 6 is a perspective view of the circuit breaker control unit after insertion of the dongle, FIGS. 7 and 8 are cross-sectional views illustrating the remote control in the open position respectively without the dongle and with a dongle inside.

Figure 9:
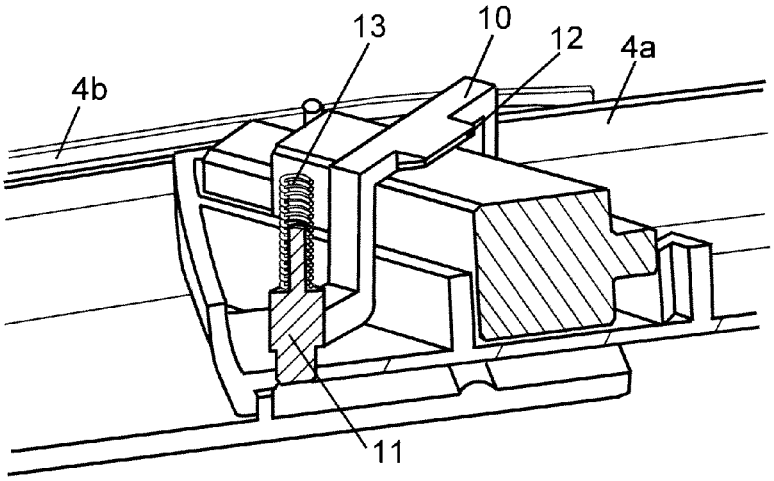
Figure 10:
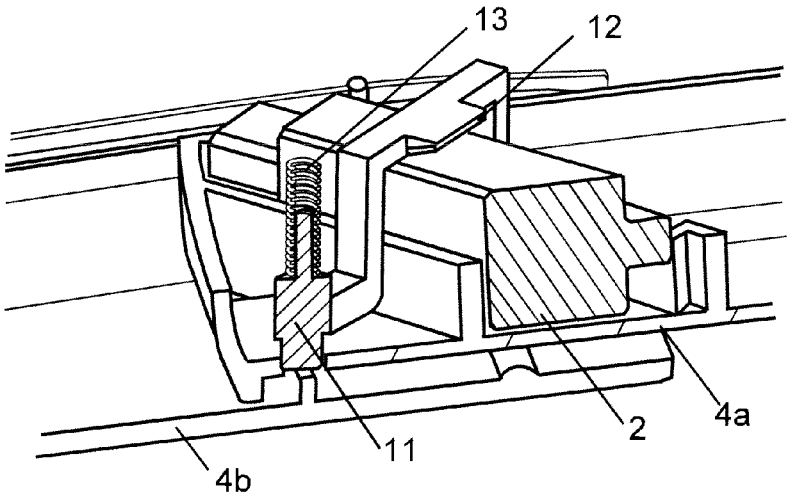
Figure 11:
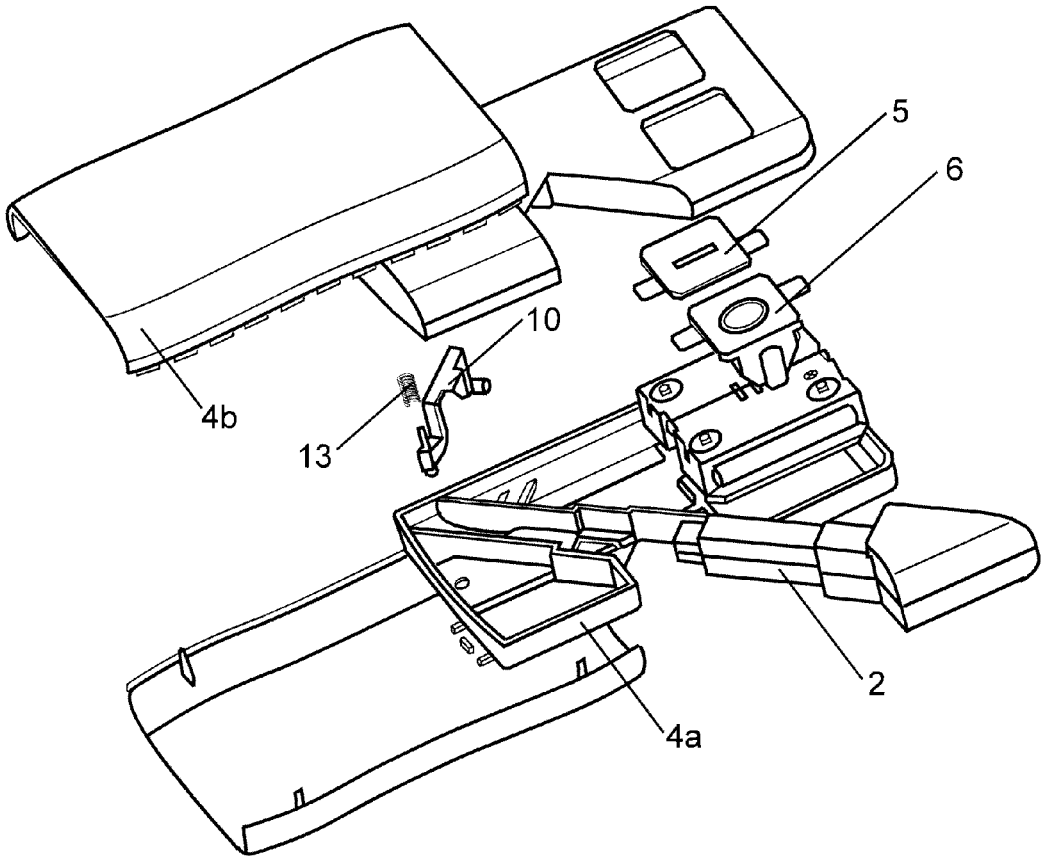
Figure 12:
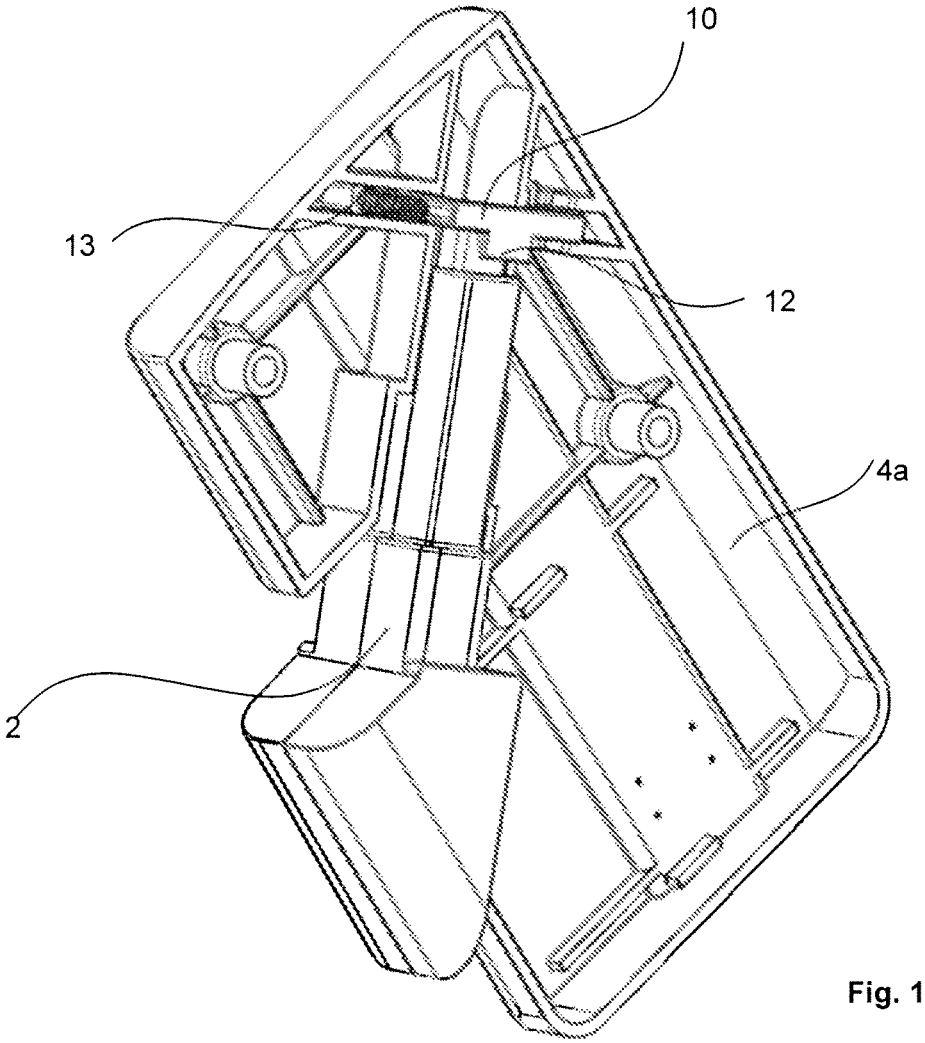
Figure 13:
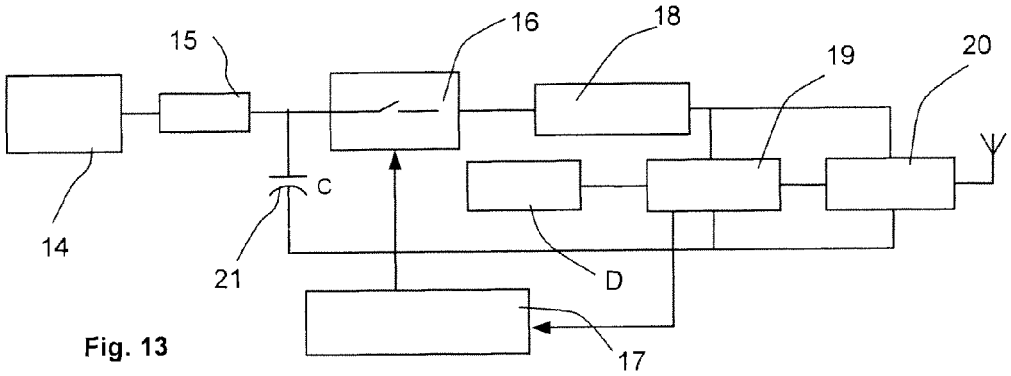
Figure 14:
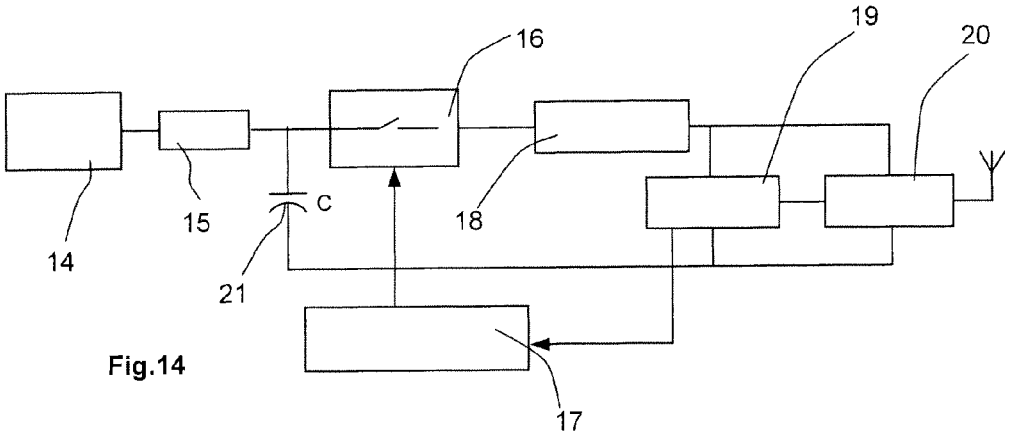
Figure 15:
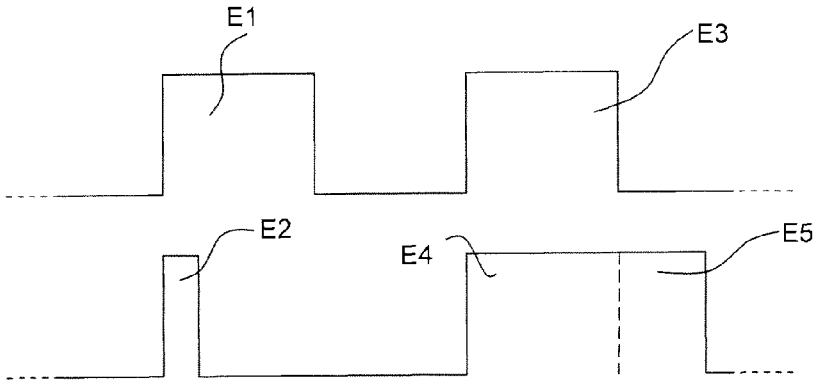

FIG. 9 is a perspective view illustrating the innards of the remote control in the same position as in the previous figure, FIG. 10 is an identical view to the previous figure in a slightly closed position of the remote control, FIG. 11 is an exploded view of the previous figure, FIG. 12 is a perspective view illustrating the part of the remote control receiving the dongle, FIGS. 13 and 14 are general electric synoptic views respectively illustrating the two sequences of the method according to the invention, and FIG. 15 is a representation illustrating two diagrams representative from top to bottom of the power produced by the user of the device and of the power consumed by the device.

In FIGS. 1 to 4 and 7 to 12, the different parts of a control device according to the invention can be seen designed to enable remote control of an electric equipment unit such as a medium-voltage electric cubicle or a power circuit breaker.

This device mainly comprises a remote control 1 and a dongle 2 designed to be fitted in removable manner in a control interface 3 of the equipment unit to be connected to the mechanism of the equipment unit by means of a connector (not shown). The equipment unit comprises a motor-driven operating mechanism, a local control unit comprising two buttons respectively for opening and closing, a switch designed to enable local or remote control of the equipment unit, and an indicator of the status of the equipment unit.

In FIG. 1, this remote control 1 is in the closed position and presents a substantially rectangular shape.

This remote control 1 is formed by a case 4 comprising two parts 4*a*, 4*b* mounted sliding with respect to one another. One 4*a* of these parts, called first part, comprises the electric control device and for this purpose presents two buttons 5,6 designed to respectively command remote opening and closing of the equipment unit, and a location 7 designed to receive the dongle 2. The second part 4*b* of this case 4 presents a substantially rectangular cross-section and comprises an opening having a shape matching the external shape of the first part 4*a* so as to enable sliding of the first part 4*a* inside the second part 4*b* between an open position as illustrated in FIG. 3 and a closed position as illustrated in FIG. 1, passing via the semi-open position illustrated in FIG. 2. The open position enables the dongle 2 to be removed from its location 7 and allows access to the actuating buttons 5,6 of the equipment unit thereby enabling remote control of the equipment unit.

This dongle 2, once it has been removed from its location 7, is designed to be fitted in the control interface 3 of the equipment unit (as illustrated in FIGS. 5 and 6) to be connected to the mechanism of the equipment unit by means of a connector (not shown).

According to the invention, this device comprises means 8 for preventing closing of the case 4 of the remote control if the dongle 2 has not been previously replaced in its location 7 inside the case 4.

These means comprise a latch 8 cooperating with the housing of the second part 4*b* of the case 4, said latch 8 being movable between a first position in which it is retracted inside the first part of case 4*a* by the fact that the dongle 2 is inserted in this first part of case 4*a*, and a position in which this latch 8 is salient from the first part 4*a* of the case and comes into contact with a part of the housing of the second part of case 4*b* when the dongle is extracted from this first part of case 4*a* so as to prevent closing of the case.

For this purpose, the latch 8 comprises a part in the form of a bridge 10 designed to receive the dongle 2 with sliding, said dongle 2 being able to slide between a part of the first part 4*a* of the case and said bridge 10 when this dongle is inserted in this first part of case or when the latter is extracted therefrom, the end part of said dongle presenting a square cross-section cooperating with the opening of the bridge.

This bridge 10 is also fitted sliding inside this first part 4*a* of the case between a bottom position in which the latching member 11 is salient from the first part of case 4*a* and cooperates with the housing of the second part of case 4*b*, the dongle not being inside the bridge, and a top position of the bridge in which the latching member 11 is retracted and releases this housing enabling relative sliding of the two parts, the dongle being inserted inside the bridge. This change of position of the bridge is obtained when the dongle is inserted, the latter cooperating with a ramp 12 belonging to the bridge 10, the latter being biased to the bottom position by a spring 13 pressing on the one hand on the housing of the first part of case 4*a* and on the other hand on the bridge 10.

This remote control enables remote operation as it operates without any wiring with a short-range radio system (for example ZigBee) operating over a few tens of meters, which means that it is able to operate through a partition (wall, door, etc.). ZigBee is a high-level protocol enabling communication of small radios with low consumption. This protocol integrates data encryption ensuring security of information between transmitters and receivers.

In order to prevent interference operation of a second equipment unit situated nearby and having a dongle inadvertently connected to its local control unit, there is unique pairing between the remote control and its dongle. At the time the remote control and its dongle are manufactured, final pairing is performed based on the MAC address of the ZigBee radio guaranteeing the impossibility of controlling two dongles from the same remote control unit.

As the equipment units are only operated very seldom, on average once every five years, the remote control advantageously only uses the power provided by pressing on the actuating buttons to supply the radio transmitter situated in the remote control, whereas the radio receiver, situated in the equipment unit, benefits from the stored low-voltage power supply of the electric control.

The remote control thus comprises two power generators respectively activated by pressing on two buttons.

The principle described with the ZigBee technology can also apply to other wireless communication technologies (for example infrared technology, etc.).

The sequencing principle will be described in the following with reference to FIGS. 13 to 15.

The electric circuitry designed to enable this sequencing comprises the following components: a generator 14, a rectifier bridge 15, a switch 16, a control device 17, a power convertor 18, a microcontroller 19 able to store a datagram D, a transceiver 20 and a capacitor 21.

In the course of sequence 1 illustrated in FIG. 13, pressing on one of the buttons or generators 14 stores energy E1 in the capacitor 21 and a part E2 of this energy is used to store the datagram D to be transmitted. Reference should advantageously be made to FIG. 15 illustrating power production and consumption during these sequencings.

In the course of sequence 2 illustrated in FIG. 14, releasing the button or the generator again stores energy E3 in capacitor, sends the stored datagram to sequence 1, this action consuming energy E4, and sends an acknowledgement of, which consumes energy E5.

Energy is thus stored twice (when pressing and when releasing the generator) with transmission of a datagram only when the button is released.

Operation of the control device according to the invention will be described in the following with reference to the figures.

In FIG. 1, the case 4 of the remote control 1 is closed and the dongle 2 is stowed inside the remote control 1.

When the user wants to use this remote control, he opens the case 4 as illustrated in FIGS. 2 and 3 and removes the dongle 2 as illustrated in FIG. 4 in order to insert the latter in the control interface 3 of the equipment unit, as illustrated in FIGS. 5 and 6.

In this position of the case, it is then possible to actuate the opening or closing buttons 5, 6 of the equipment unit.

When one or the other of these buttons is actuated, the device operates according to the sequencing described in the above.

In this open position of the remote control, it is impossible to close the case 4 of the remote control, for without the presence of the dongle 2, the bridge 10 is biased to the bottom position and the latching member 11 of the latch 8 prevents relative sliding of the two parts 4*a*, 4*b* of the case 4, as illustrated in FIG. 7.

After the remote control 1 has been used, the user puts the dongle 2 back in its location 7 inside the case 4, which leads to the bridge 10 being moved to a top position as illustrated in FIGS. 8 and 9, resulting in the latching member 11 in a retracted position enabling relative sliding of the two parts 4*a*,4*b* of the case 4 and therefore closing of the case 4.

The dongle 2 is thus stowed in the case of the remote control 1 at the end of handling and the housing cannot be closed if the dongle is not present in its housing, which prevents the operator from forgetting the dongle on the product and then spending time looking for it, for example in the case of use on a very extensive site (for example a petrol refinery).

The invention therefore enables remote control of an electric equipment unit such as a medium-voltage cubicle, a power circuit breaker, etc. to be performed without any wiring and without any batteries by means of a simple device, with clear identification of the cubicle to be operated by means of a dongle, making control errors of a neighbouring cubicle practically improbable. It is thus possible to remote-operate different types of equipment units of the same manufacturer while at the same time guaranteeing control of the right unit (and not another unit), in simple and inexpensive manner. By means of the invention, remote control is also assigned to a single person, which also constitutes an advantage guaranteeing safety of operation.

It should also be noted that the connector used is advantageously standard. The electrician can thus, with one and the same remote control, operate medium-voltage or low-voltage equipment or any device such as controllers or protection relays which act on circuit breakers, or switches whether the latter be overhead or underground.

It should also be noted that the transmission system will advantageously be a short-range radio transmission system, but the latter may under other circumstances be an infrared system.

The invention is naturally in no way limited to the embodiments that have been described and illustrated which have been given for example purposes only.

On the contrary, the invention extends to encompass all technical equivalents of the means described as well as combinations thereof if the latter are performed according to the spirit of the invention.

The invention claimed is:

1. A remote control device for an electric equipment unit, comprising;

a remote control comprising at least one button for actuating an equipment unit by remote transmission means located partly in the remote control and partly in an interface of the equipment unit, a dongle for insertion into a control interface of an equipment unit, which interface is connected to a mechanism of the equipment unit by a connector, said dongle being controlled by the remote control for transmitting control orders from the remote control to the mechanism of the equipment unit, said dongle for being stowed in a designated location inside the housing of the remote control:

wherein the housing comprises a case for being transformed into two different positions, namely an open position and a closed position, said case additionally comprising means for preventing the case from being in the closed position if said, dongle is not in its designed location within the housing;

said case comprising two parts slidable with respect to each other, a latch slidably fitted within one of said parts for sliding between two latch positions, said latch being movable by said dongle when the dongle is inserted into and removed from the housing, so that when the dongle is removed from the housing the latch is in an active position wherein the latch cooperates with the other part of the case to prevent slidable relative movement of said two parts, and when the dongle is inserted into the housing the latch is in an inactive position.

2. The control device according to claim 1, additionally comprising a pairing device for communicating between the remote control and the dongle, for enabling the remote control to identify the equipment unit to be commanded.

3. The control device according to claim 1, wherein the transmission means comprise wireless transmission means.

4. The control device according to claim 3, wherein the transmission means comprise a ZigBee short-range radio system, and pairing means comprise a MAC address of the ZigBee radio system.

5. The control device according to claim 1, wherein the permits access to an actuating button of the remote control when the case is in the open position, and prevents access to when the case is in the closed position.

6. The control device according to claim 1, wherein the latch comprises a bridge slidably mounted; inside the first part of the case, and a latching member, the dongle being slidable between the first part of the case and said bridge when the dongle is inserted or removed, and cooperating with said bridge for moving the bridge between a first position in which the latching member is inside the housing, and a second position in which the latching member is salient from the housing thereby interfering with the housing of the second and preventing relative sliding of the two parts, said latch being biased to the inactive position by a spring.

7. The control device according to claim 6, wherein the dongle cooperates with a ramp on the bridge.

8. The control device according to claim 1, wherein the housing comprises indicating means for informing the user of receipt of a control order from the equipment unit.

9. The control device according to claim 1, wherein the equipment unit is a medium-voltage switch, circuit breaker, controller or protection relay, for controlling a circuit breaker or a switch.

10. The control device according to claim 1, wherein the remote control is powered by an energy generating system without batteries, the energy being provided by pressing or releasing the button.

11. The control device according to claim 1, additionally comprising:

a local control unit located inside an electric equipment unit, and comprising two buttons for, respectively, commanding opening and closing of the equipment unit, a two-position switch for authorizing either the local control or the remote control, and a connector for receiving a dongle for enabling remote control of the equipment unit.

12. The control device according to claim 1, wherein the indicating means comprises an LED in the housing.

13. The control device according to claim 1, wherein the remote control and its dongle have complementary shapes.

* * * * *